US009231338B2

(12) United States Patent
Nagy et al.

(10) Patent No.: US 9,231,338 B2
(45) Date of Patent: Jan. 5, 2016

(54) VARIABLE WIRE STRAIN RELIEF CONNECTOR

(71) Applicant: Sumitomo Electric Wiring Systems, Inc., Northville, MI (US)

(72) Inventors: Brian Nagy, Woodhaven, MI (US); Joseph Lanzotti, Grosse Pointe, MI (US)

(73) Assignee: Sumitomo Electric Wiring Systems, Inc., Northville, MI (US)

( * ) Notice: Subject to any disclaimer, the term of this patent is extended or adjusted under 35 U.S.C. 154(b) by 22 days.

(21) Appl. No.: 14/225,675

(22) Filed: Mar. 26, 2014

(65) Prior Publication Data

US 2015/0280359 A1 Oct. 1, 2015

(51) Int. Cl.
*H01R 13/58* (2006.01)

(52) U.S. Cl.
CPC ..... *H01R 13/5812* (2013.01)

(58) Field of Classification Search
CPC ..... H01R 13/506; H01R 13/56; H01R 13/58; H01R 21/03
USPC ..... 439/466, 465, 467, 731
See application file for complete search history.

(56) References Cited

U.S. PATENT DOCUMENTS 5,588,870 A * 12/1996 Boteler et al. ..... 439/467
5,591,046 A * 1/1997 Klein et al. ..... 439/467

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A connector (10) includes a housing (12) with a terminal receiving cavity (22) and a wire receptacle (24) communicating with the terminal receiving cavity (22). The wire receptacle (24) includes at least one V-shaped wire support (40) for supporting a wire (50) at two circumferentially spaced positions on the wire (50). A cover (60) is mounted to the housing (12) and has at least one resiliently deflectable strain relief beam (70) that biases the wire (50) into the wire receptacle (24).

10 Claims, 4 Drawing Sheets

VARIABLE WIRE STRAIN RELIEF CONNECTOR

BACKGROUND

1. Field of the Invention

The invention relates a connector to provide strain relief for large diameter wires, such as high current battery cables, and particularly for such wires that may be subject to variation in outer diameter.

2. Description of the Related Art

A wire includes a conductive core and an insulating coating surrounding the core. The insulation is removed near the end of the wire so that the conductive core can be connected to a terminal fitting, typically by welding, soldering or crimping. The assembly of the wire and the terminal fitting then may be mounted into a housing made of a synthetic resin or other nonconductive material. The wire, the terminal fitting and the housing form a connector that can be connected to a mating connector so that the terminal fitting of the connector is connected electrically to a mating terminal fitting in the mating connector.

Electrical connectors often are used in high vibration environments and/or in environments where forces may be exerted on the portion of the wire extending from the connector. Vibration of the connector and forces exerted on the wire can be transmitted to the welded, soldered or crimped connection between the conductive core of the wire and the terminal fitting, and can cause the electrical connection to degrade or fail. As a result, connectors that are used in a high vibration environment or in an environment where the wire may be subject to external forces typically have a strain relief feature. The strain relief feature typically involves placing one or more bends in the wire and tightly positioning the bends between rigid structures within the housing. The secure positioning of bent portions of the wire in the housing prevents or severely limits relative movement of the portion of the wire in the housing and hence eliminates or minimizes the effects of vibration or external forces on the soldered, welded or crimped connection between the conductive core of the wire and the terminal fitting.

The prior art strain relief structure described above works well on small diameter wires that can be bent easily and positioned adjacent rigid structures within the housing of the connector. However, large diameter wires, such as battery cables, are not bent easily. As result, the prior art strain relief structures that work well on small diameter wires are not well-suited for larger less pliable wires, such as high current battery cables.

Large diameter wires, such as battery cables, also are more likely to be subject to variation in outside diameter. The variations may be due to standard manufacturing tolerances or due to different manufacturing techniques used by suppliers of cables. Thus, prior art approaches for urging a wire into a specific nonlinear shape adjacent to rigid structures within the housing often will not provide the required strain relief due to variations in the outside diameter of the large diameter wire.

In view of the above, an object of the subject invention is to provide a strain relief structure that is particularly well suited for cross-sectionally large wires, such as high current battery cables.

Another object of the invention is to ensure adequate strain relief despite variations in cross-sectional dimensions of the wires or cables that extend into the housing of the connector.

SUMMARY OF THE INVENTION

The invention relates to a connector with strain relief features that are particularly well-suited for use with large diameter wires, such as battery cables. The connector of the subject invention includes a housing formed from a nonconductive material, such as a synthetic resin. The housing has at least one cavity for accommodating a terminal fitting and at least part of a wire connected to the terminal fitting. More particularly, the housing includes a mating end with an opening so that the terminal fitting accommodated in the cavity can be connected electrically to a mating terminal fitting on a device or in a mating housing. The housing also includes a wire draw-out opening for accommodating the wire connected to the terminal fitting mounted in the cavity of the housing. The wire draw-out opening can be aligned axially with the opening at the mating end of the housing or may be aligned at an angle, such as a right angle, to the opening at the mating end of the housing. A side of the housing adjacent the wire draw-out opening includes a strain relief opening that exposes one longitudinal side of the wire mounted in the housing, and specifically a part of the wire that includes the insulating coating.

The connector further includes a cover that can be mounted on and locked to the housing for closing the strain relief opening. For example, the cover may include a base wall and a plurality of sidewalls projecting from the base wall. The sidewalls of the cover preferably include locking structures for locked engagement with corresponding locking structures on sidewalls of the housing.

The housing and the cover further include strain relief structures for engaging the wire securely and preventing relative movements between the wire, the terminal fitting, the housing and the cover. As a result, connector can be subjected to vibration and the wire can be subjected to forces without adversely affecting the electrical and mechanical connection between the wire and the terminal fitting.

The strain relief structure preferably comprises at least one rigid wire support on the housing or in the cover and at least one resiliently deflectable wire support on the other of the housing and the cover. The at least one rigid wire support preferably comprises at least two rigid wire supports that are spaced from one another along the axial direction of the portion of the wire disposed in the housing. The rigid wire support may be substantially V-shaped to define a recess into which the outer circumferential surface of the wire may be nested. The at least one resiliently deflectable support preferably is disposed between the axially spaced rigid wire supports. The at least one resiliently deflectable support preferably comprises two deflectable supports disposed to engage circumferentially spaced positions on the insulation coating of the wire. The rigid and deflectable wire supports are disposed and dimensioned to squeeze the wire between the housing and the cover when the cover is mounted to the housing. As a result, movement of the wire within the housing is prevented despite vibration of the housing and despite forces exerted on the wire external out the housing. Accordingly, the connection of the wire to the terminal fitting is not affected by vibration or forces exerted on the wire.

The rigid wire supports preferably are provided in the housing and the deflectable supports preferably are provided on the cover. The deflectable supports resiliently deflect as the cover is locked to the housing for closing the strain relief opening of the housing.

The V-shape of the rigid wire support ensures that the outer circumferential surface of the wire will be engaged at two circumferentially spaced positions despite variations in the outside diameter of the wire. The preferred provision of two axially-spaced V-shaped rigid supports ensures that the outer circumferential surface of the wire will be engaged at a total of four positions.

The resiliently deflectable supports can deflect sufficiently to accommodate a range of outside diameters of wires while still squeezing the wires sufficiently against the at least one rigid support to achieve the required strain relief.

The resiliently deflectable supports preferably are support beams cantilevered from the sidewalls of the cover and projecting toward one another. However, a single deflectable support beam may be formed to extend between the opposed side walls of the cover.

DETAILED DESCRIPTION OF THE PREFERRED EMBODIMENT

Figure 1:
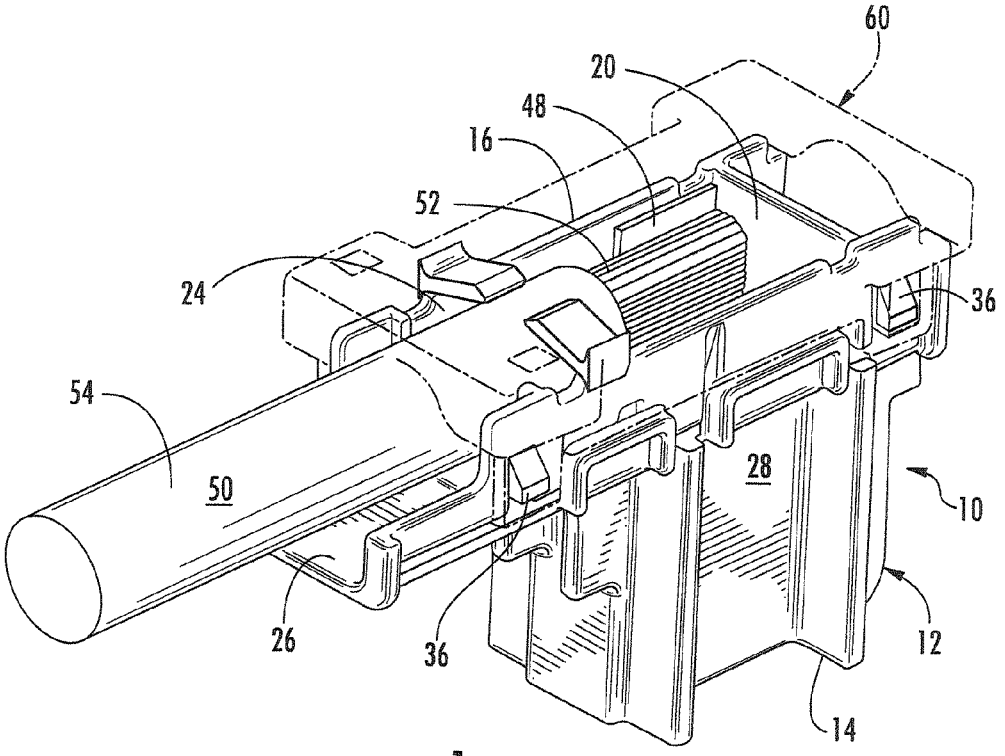
FIG. 1 is a perspective view of a connector in accordance with the subject invention.
Figure 2:
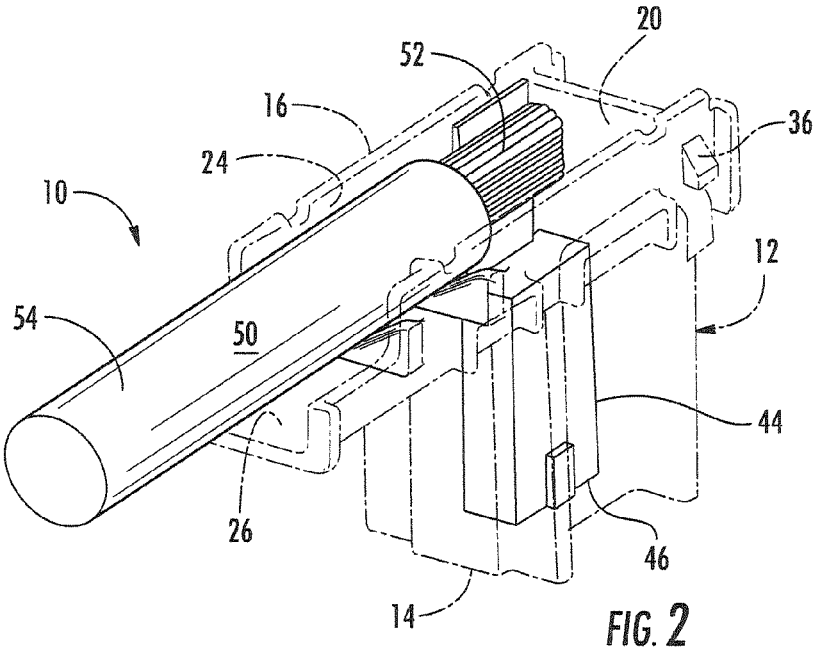
FIG. 2 is a perspective view of the housing of the connector of FIG. 1 with the cover removed.
Figure 3:
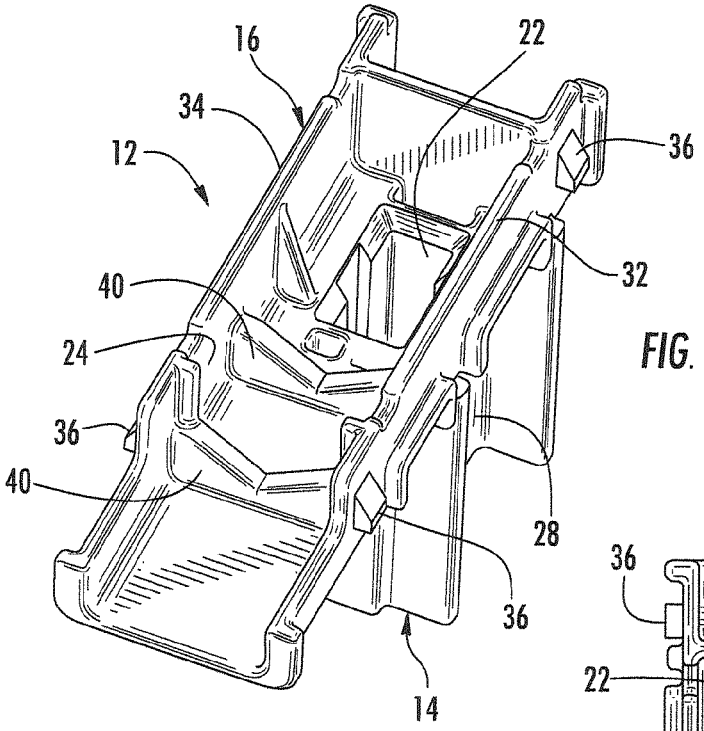
FIG. 3 is a perspective view of the housing of FIG. 2 with the wire and terminal fitting removed.
Figure 4:
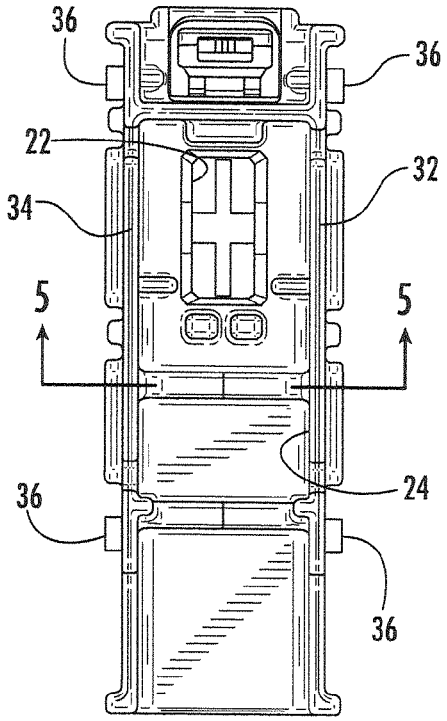
FIG. 4 is a top plan view of the housing.
Figure 5:
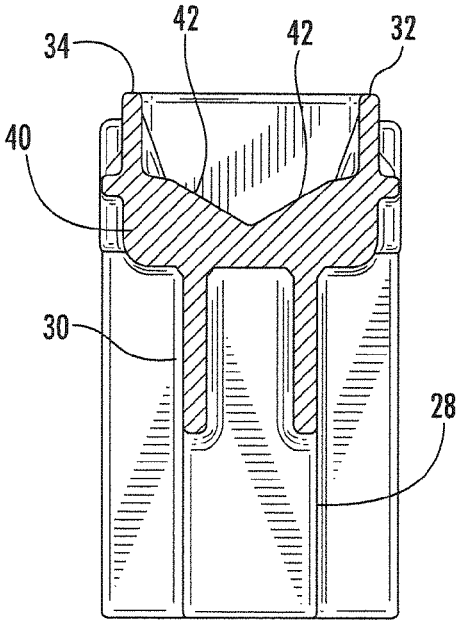
FIG. 5 is a cross-sectional view taken along line 5-5 in FIG. 4.
Figure 6:
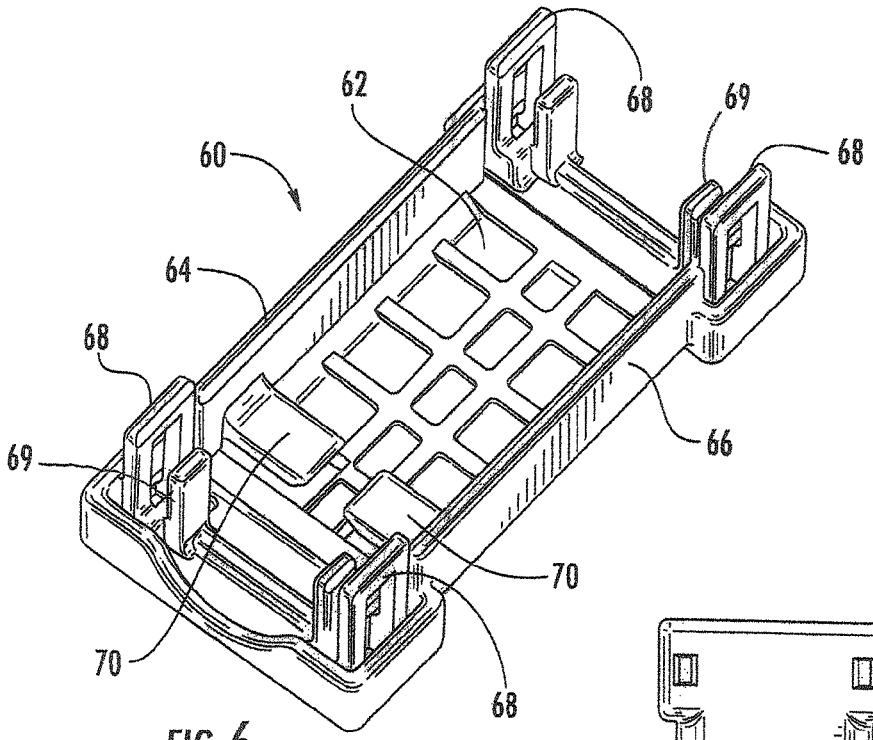
FIG. 6 is a bottom perspective view of the cover.
Figure 7:
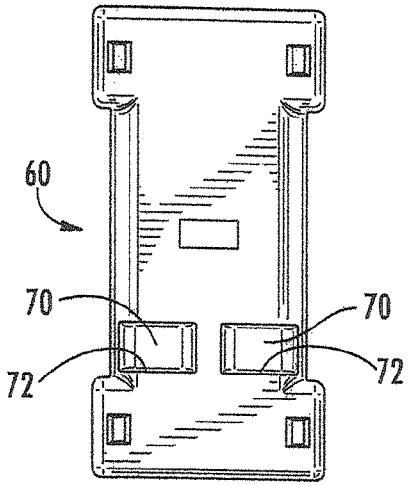
FIG. 7 is a top plan view of the cover.
Figure 8:
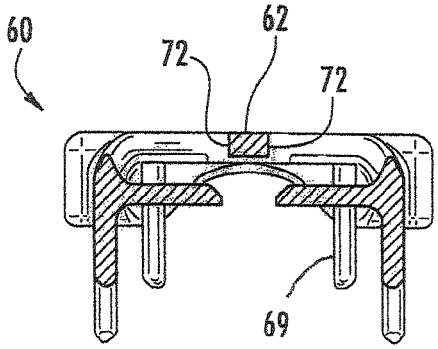
FIG. 8 is a cross-sectional view taken through the strain relief beams of the cover.

A variable strain relief connector in accordance with the subject invention is identified generally by the numeral 10 in FIGS. 1-10. The connector 10 includes a housing 12 with opposite front and rear ends 14 and 16 that are spaced apart along a terminal insertion direction and a mating direction. A mating opening 18 is formed at the front end 14 of the housing 12 and an insertion opening 20 is formed at the rear end 16 of the housing 12. A terminal receiving cavity 22 extends from the front end 14 to the rear end 16 of the housing and provides communication between the mating opening 18 and the insertion opening 20. The housing 12 further includes a wire receptacle 24 that is open to the insertion opening 20 at the rear end 16 of the housing 12 and extends transversely from the terminal receiving cavity 22 to a concave wire draw-out opening 26. In other embodiments, however, the wire receptacle 24 may be aligned axially with the terminal receiving cavity 22 and may extend along the mating direction. In those alternate embodiments, an insertion opening 20 may be formed along a side of the housing extending from the wire draw-out opening 26 toward the mating opening.

The housing 12 also includes opposite sidewalls 28 and 30 that extend along the mating direction from the front end 14 to the rear end 16 of the housing 12. Opposite rear edges 32 and 34 extend along the sidewalls 28 and 30 respectively at the rear end 16 of the housing 12 and define opposite sides of the insertion opening 20. Locks 36 project out from areas on the sidewalls 28 and 30 in proximity to the rear edges 32 and 34. Each lock 36 has a sloped surface that is sloped out from the respective sidewall 28, 30 and away from the rear edges 32, 34. Each lock 36 also has a locking surface aligned substantially perpendicular to the respective sidewall 28 and 30. At least one lock (not shown) also may be formed in the terminal receiving cavity 22 for locking a terminal fitting therein as explained further below. The lock in the terminal receiving cavity 22 may be of conventional design, and may include a locking lance formed on a wall of the housing or may be a locking edge formed in the terminal receiving cavity 22 that is engaged by a locking lance formed on the terminal fitting.

The wire receptacle 24 extends from the terminal receiving cavity 22 to the wire draw-out opening 26 and includes first and second V-shaped wire supports 40 that are spaced apart from one another in a direction transverse to the mating direction and the insertion direction. Each wire support 40 has two planar support surfaces 42 that intersect at a location substantially centrally between the sidewalls 28 and 30 and that diverge from one another at positions closer to the rear end 16 of the housing 12.

The connector 10 further includes a terminal fitting 44 configured for insertion into the terminal receiving cavity 22 of the housing 12. The terminal fitting 44 has a mating end 46 that is substantially adjacent the front end 14 of the housing 12 when the terminal fitting 44 is inserted into the terminal receiving cavity 22. Additionally, the mating end 46 of the terminal fitting 44 at least partly aligns with the mating opening 18 so that the terminal fitting 44 can connect to a mating terminal fitting of an electrical device or a mating connector. The terminal fitting 44 further has a connection end 48 opposite the mating end 46. The connection end 48 of the terminal fitting 44 is in proximity to the rear end 16 of the housing 12 when the terminal fitting 44 is mounted in the terminal receiving cavity 22.

The connector 10 further includes a wire 50 having an electrically conductive core 52 and an insulation coating 54 surrounding the core 52. A portion of the insulation coating 54 at one end of the wire 50 is removed to expose the core 52. The core 52 then is connected to the connection end 48 of the terminal fitting 44. In the illustrated embodiment, the wire 50 is a large diameter cable intended for high current applications. For example, the wire 50 may be a battery cable and the connector 10 may be configured for connection to a battery. However, the invention is not limited to large diameter high current cables and has applicability to all wires that require strain relief. In the illustrated embodiment, the core 52 of the wire 50 is connected to the connection end 48 of the terminal fitting 44 by welding or soldering. However, other known connection techniques can be employed, such as crimping or insulation displacement. Additionally, the illustrated embodiment shows the longitudinal axis of the wire 50 extending substantially transverse to the mating direction that extends between the front and rear ends 14 and 16 of the housing 12. However, the longitudinal axis of the wire 50 can be aligned along the mating direction.

The wire 50 is positioned in the wire receptacle 24 of the housing 10 when the terminal fitting 44 is inserted into the terminal receiving cavity 22. More particularly, the insulation coating 54 of the wire 50 is supported on the V-shaped wire supports 40 in the wire receptacle 24. As a result, the outer circumferential surface of the insulation coating 54 of the wire 50 will be supported substantially tangentially on the support surfaces 42 of the respective V-shaped wire supports 40.

The connector 10 further includes a cover 60 that is mountable to the rear end 16 of the housing 12. More particularly, the cover 60 includes a base wall 62 configured to cover the insertion opening 20 at the rear end 16 of the housing 12. The cover 60 further includes sidewalls 64 and 66 that project substantially parallel to one another from the base wall 62. The side walls 64 and 66 of the cover 60 are disposed to telescope over the ends of the sidewalls 28 and 30 of the housing 12 adjacent to the rear edges 32 and 34 that define the insertion opening 20 at the rear end 16 of the housing 12.

Resiliently deflectable latches 68 project from the sidewalls 64 and 66 of the cover 60 and are configured to engage in the locks 36 on the sidewalls 28 and 30 of the housing 12 when the cover 60 is mounted to the rear end 16 of the housing 12. The cover 60 also includes positioning walls 69 at positions inward and substantially aligned with the latches 68. The positioning walls 69 telescope inward of the sidewalls 28 and 30 to ensure proper positioning of the cover 60 and to prevent inward deformation of the sidewalls 28 and 30 in a direction away from the latches 68 that could disengage the latches 68 from the locks 36 on the sidewalls 28 and 30.

Figure 10:
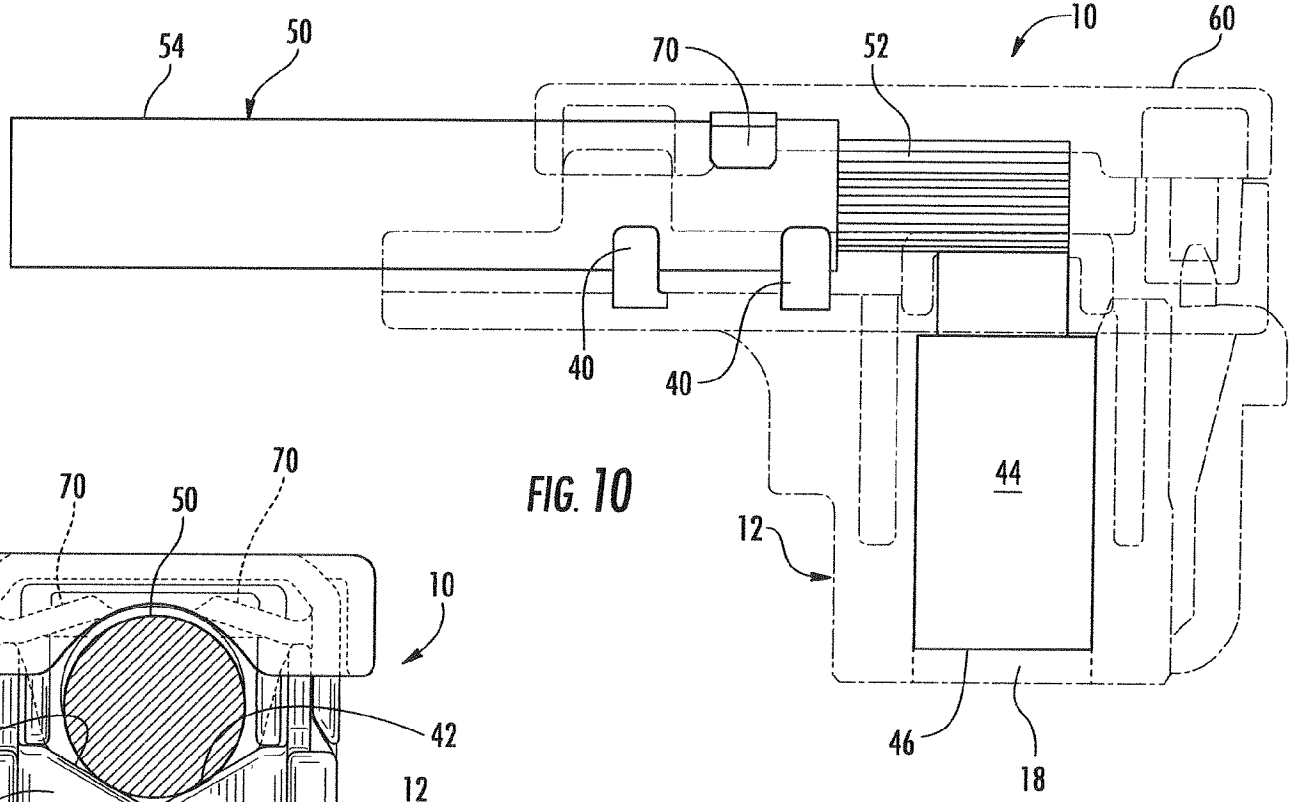
FIG. 10 is a side elevational view of the assembled connector.
Figure 9:
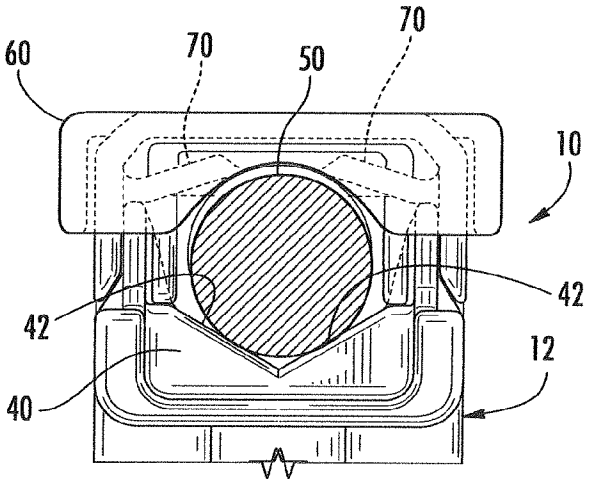
FIG. 9 is an elevational view of the assembled connector taken from the left side in FIG. 1.

The cover 60 further includes resiliently deflectable strain relief beams 70 cantilevered inward and toward one another from the sidewalls 64 and 66 of the cover 60. The deflectable strain relief beams 70 are at positions to align with the space between the V-shaped wire supports 40. Additionally, openings 72 are provided in the base wall 62 to facilitate molding the strain relief beams 70. The deflectable strain relief beams 70 are at positions relative to the base wall 62 to be biased against the outer circumferential surface of the insulation coating 54 of the wire 50 when the cover 60 is mounted to the housing 12. With this configuration, as shown in FIGS. 9 and 10, the deflectable strain relief beams 70 are deflected toward the base wall 62. However, resilient restoring forces of the deflectable strain relief beams 70 are exerted on the outer circumferential surface of the insulation coating 54 of the wire 50 and urge the wire 50 tightly against the V-shaped wire supports 40. With this construction, the outer circumferential surface of the insulation coating 54 of the wire is engaged tightly at six locations, namely the two support surfaces 42 of each of the V-shaped wire supports 40 and the two engaging surfaces of the respective deflectable strain relief beams 70.

The entire connector 10 may be subject to vibrations during use, for example, if the connector 10 is used in a motor vehicle. Additionally, the parts of the wire 50 external of the connector 10 can be subjected to forces, for example, when a worker is installing the connector 10 or when a worker requires access to an area near the connector 10. However, the engagement of the outer circumferential surface of the insulation coating 54 by the resiliently deflectable strain relief beams 70 and the V-shaped wire supports 40 prevents relative movement between the wire 50 and the terminal fitting 44 so that the electrical connection between the conductive core 52 of the wire 50 and the terminal fitting 44 is unaffected by vibrations or forces exerted on the wire 50 at locations external of the connector 10. Significantly, the strain relief is achieved without having to bend the wire 50. As a result, the connector 10 is well-suited for use with cross-sectionally large high current battery cables that are not very pliable and typically cannot be bent sufficiently for strain relief purposes.

The outside diameter of the wire 50 is not uniform along the length of the wire. Additionally, wires 50 from one manufacturer may be cross-sectionally different from wires obtained from another manufacturer. However, the resiliently deflectable strain relief beams 70 can achieve adequate strain relief despite variations in the outside diameter of the wire 50. Additionally, it is possible to have a universal housing 12 that can be used with a plurality of different covers 60. Each cover 60 can have resiliently deflectable strain relief beams 70 located and dimensioned to exert sufficient strain relief forces on differently dimensioned wires 50.

The invention has been described and illustrated with respect to a preferred embodiment. However, various changes can be made without departing from the scope of the invention as defined by the appended claims.

The illustrated embodiment is configured so that the axial direction of the wire 50 is perpendicular to the mating direction of the terminal fitting 44. However, the axial direction of the wire 50 may be aligned with the mating direction of the terminal fitting 44. In this embodiment, the housing 10 will be open on a lateral side and the cover will be mounted to the opening on the lateral side of the housing.

The illustrated embodiment has the resiliently deflectable strain relief beams 70 on the cover 60 and has the V-shaped wire supports 40 on the housing 12. However, this arrangement can be reversed so that the V-shaped wire supports 40 are on the cover and the resiliently deflectable strain relief beams 70 are in the housing 12

The illustrated embodiment shows two V-shaped wire supports 40 that are spaced apart in the axial direction of the wire 50, and the resiliently deflectable strain relief beams 70 align with the space between the V-shaped wire supports 40. However, the resiliently deflectable strain relief beams 70 may align with the V-shaped wire supports 40. Alternatively, the connector may have two axially spaced pairs of deflectable strain relief beams 70 disposed on opposite respective sides of a single V-shaped wire support 40.

The V-shaped wire supports 40 of the illustrated embodiment are formed by planar surfaces 42 that intersect between the sidewalls 28 and 30 of the housing 12. However, at least parts of the surfaces 42 may be curved concavely or convexly.

We claim:

1. A connector, comprising:

a housing having at least one terminal receiving cavity and at least one wire receptacle communicating with the terminal receiving cavity for receiving a terminal connected to a wire, the wire receptacle including first and second V-shaped wire supports spaced from one another and disposed to engage the wire at axially spaced positions on the wire; and a cover mounted to the housing and having at least one resiliently deflectable strain relief beam opposed to the wire receptacle and aligned with a space between the first and second V-shaped wire supports, the resiliently deflectable strain relief beam being configured for urging the wire tightly into the wire receptacle.

2. The connector (10) of claim 1, wherein the housing (12) is formed with a plurality of locks (36) and the cover (60) has a plurality of latches (68) engaged with the locks (36) to hold the cover (60) on the housing (12) and to keep the resiliently deflectable strain relief beam (70) biased against the wire (50).

3. A connector, comprising:

a housing having at least one terminal receiving cavity and at least one wire receptacle communicating with the terminal receiving cavity; and a cover mounted to the housing and having at least one resiliently deflectable strain relief beam opposed to the wire receptacle and configured for urging a wire tightly into the wire receptacle, wherein the resiliently deflectable strain relief beam is cantilevered into a position for engaging the wire in the wire receptacle.

4. A connector, comprising:

a housing having at least one terminal receiving cavity and at least one wire receptacle communicating with the terminal receiving cavity; and a cover mounted to the housing and having at least one resiliently deflectable strain relief beam opposed to the wire receptacle and configured for urging a wire tightly into the wire receptacle, wherein the cover has a base wall configured for covering at least the wire receptacle and further having first and second sidewalls telescoped into engagement with the housing, the at least one strain relief beam is a first strain relief beam cantilevered from the first side wall of the cover, the cover further comprising a second strain relief beam cantilevered from the second side wall of the cover.

5. A connector, comprising:

a housing having at least one terminal receiving cavity and at least one wire receptacle communicating with the terminal receiving cavity;

at least one terminal fitting mounted in the terminal receiving cavity of the housing;

a wire having a conductive core soldered or welded to the terminal fitting and an insulation coating surrounding at least parts of the conductive core, the insulation coating being supported in the wire receptacle of the housing; and a cover mounted to the housing and having at least one resiliently deflectable strain relief beam cantilevered toward the wire receptacle and biasing the wire into the wire receptacle.

6. The connector of claim 5, wherein the terminal fitting has a mating end configured for connection to a mating terminal fitting and a connection end connected to the conductive core along a mating direction, the wire in the wire receptacle being aligned substantially perpendicular to the mating direction.

7. The connector of claim 5, wherein the cover has two resiliently deflectable strain relief beams cantilevered toward one another and biasing the wire into the wire receptacle.

8. The connector of claim 7, wherein the wire receptacle includes at least one V-shaped wire support for supporting the wire at two circumferentially spaced locations thereon.

9. The connector of claim 8, wherein the at least one V-shaped wire support is a first V-shaped wire support, and wherein the housing further includes a second V-shaped wire support spaced from the first V-shaped wire support (40) and disposed to engage the wire at a position axially spaced from the first V-shaped wire support.

10. The connector of claim 9, wherein the resiliently deflectable strain relief beams are aligned with a space between the first and second V-shaped wire supports.

* * * * *